US005651095A

United States Patent [19]

Ogden

[11] Patent Number: 5,651,095

[45] Date of Patent: Jul. 22, 1997

[54] SPEECH SYNTHESIS USING WORD PARSER WITH KNOWLEDGE BASE HAVING DICTIONARY OF MORPHEMES WITH BINDING PROPERTIES AND COMBINING RULES TO IDENTIFY INPUT WORD CLASS

[75] Inventor: Richard Ogden, York, United Kingdom

[73] Assignee: British Telecommunications public limited company, London, England

[21] Appl. No.: 193,537

[22] Filed: Feb. 8, 1994

[30] Foreign Application Priority Data

Oct. 4, 1993 [EP] European Pat. Off. ..... 93307872

[51] Int. Cl.[6] ..... G10L 5/02; G10L 9/00

[52] U.S. Cl. ..... 395/2.69; 395/2.66

[58] Field of Search ..... 395/2.67, 2.69, 395/2.85, 2.6, 2.66, 2.64; 381/36, 48, 51–52

[56] References Cited

U.S. PATENT DOCUMENTS

| | | | |
|---|---|---|---|
| 4,685,135 | 8/1987 | Lin et al. | 381/52 |
| 4,692,941 | 9/1987 | Jacks et al. | 381/52 |
| 4,783,811 | 11/1988 | Fisher et al. | 381/52 |
| 4,797,930 | 1/1989 | Goudie . | |
| 5,040,218 | 8/1991 | Vitale et al. | 381/52 |
| 5,157,759 | 10/1992 | Bachenko | 395/2 |
| 5,212,731 | 5/1993 | Zimmermann | 381/52 |
| 5,511,213 | 4/1996 | Correa | 395/800 |

OTHER PUBLICATIONS

Berendsen et al, "Morphology and Stress In a Rule–Based Grapheme–To–Phoneme Conversion System for Dutch", Eurospeech 87, European Conference on Speech Technology, vol. 1, Sep. 1987, Edinburgh, Scotland, pp. 239–242.

Williams, "Word Stress Assignment in a Text–To–Speech Synthesis System for British English", Computer Spech and Language, vol. 2, No. 3–4, Sep. 1987, London, GB, pp. 235–272.

Local, "Modelling Assimilation in Non–Segmental Rule–Synthesis"; in D.R. Ladd and G.Docherty (Editors): Papers in Laboratory Phonology IT, Cambridge University Press, 1992, pp. 190–224.

Coleman, "Synthesis–by–Rule Without Segments or Rewrite–Rules"; G. Bailly, C. Beniot and T.R. Sawallis (Editors): Talking Machines; Theories, Model and Designs, Elsevier Science Publishers, 1992, pp. 43–60.

Ogden, "Temporal Interpretation of Polysyllabic Feet in the YorkTalk Speech Systhesis System", paper submitted to the European Chapter of the Association of Computational Linguistics 1992, pp. 1–6.

(List continued on next page.)

*Primary Examiner*—Allen R. Macdonald
*Assistant Examiner*—Richemond Dorvil
*Attorney, Agent, or Firm*—Nixon & Vanderhye P.C.

[57] ABSTRACT

A speech synthesis system includes a phonological converter, a word parser, a syllable parser, temporal and parametric interpreters, a file and a synthesizer. The word parser and syllable parser receive an input text which includes words in a defined word class. The word parser parses each word to determine whether it belongs to the defined class of words. The parser includes a knowledge base containing the individual morphemes utilized in the defined word class, each morpheme being a root or an affix, the binding properties of each root and each affix, the binding properties for each affix also defining the binding properties of the combination of the affix and another affix or another root, and a set of rules defining the manner in which the roots and affixes may be combined to fore words. The syllable parser determines the phonological features of the constituents of each syllable of the input text. The metrical parser determines the stress pattern of the syllables of each word. The temporal and parametric interpreters interpret the phonological features together with the stress pattern to produce a series of sets of parametric values for driving the synthesizer. The synthesizer produces a speech waveform. If desired, the parameter values may be stored in the file for later use.

14 Claims, 4 Drawing Sheets

OTHER PUBLICATIONS

Ogden, "Parametric Interpretation in YorkTalk", York Papers in Linguistics 16 (1992), pp. 81–89.
Klatt, "Software for a Cascade/Parallel Formant Synthesizer", Journal of the Acoustical Society of America 67(3), pp. 971–995.
Coleman et al, "Monostratal Phonology and Speech Synthesis", Paper presented to a Graduate Seminar at the University of York, Oct. 1987.
Coleman, "Unification Phonology, Another Look at Synthesis–by–Rule", conference proceedings, COLING 1990, Helsinki, pp. 1–6.
Ogden, "YorkTalk, Phonological Parsing for Speech Synthesis", paper submitted at a conference on AI, Summer 1992, pp. 1–9.
Ogden, "A Linguistic Analysis of the Phonology and Morphology of Latinate Words for Computation", paper presented to LAGB Autumn Meeting, University of Surrey, 16 Sep. 1992.

IEE Colloquium on 'Grammatical Inference: Theory, Applications and Alternatives', Arnfield et al., "A syntax based grammar of stress sequences", pp. 7/1–7 Apr. 1993.

ICASSP 91. 1991 International Conference on Acoustics Speech and Signal Processing, Sullivan et al., "Speech synthesis by analogy: recent advances and results", pp. 761–764 vol. 2 May 1991.

SPEECH SYNTHESIS USING WORD PARSER WITH KNOWLEDGE BASE HAVING DICTIONARY OF MORPHEMES WITH BINDING PROPERTIES AND COMBINING RULES TO IDENTIFY INPUT WORD CLASS

BACKGROUND OF THE INVENTION

1. Field of the Invention

This invention relates to a speech synthesis system for use in producing a speech waveform from an input text which includes words in a defined word class and also to a method for use in producing a speech waveform from such an input text.

2. Related Art

In producing a speech waveform from an input text, it is important to find the stress pattern for each word. One method of doing this is to provide a dictionary containing all the words of the language from which the text is taken and which shows the stress pattern of each word. However, it is both technically more efficient and linguistically more desirable to parse the individual words of the text to find their stress patterns. Where the input text contains words in a defined word class which exhibit a different stress pattern from other words in the input text, it is necessary to parse each word to determine if it belongs to the defined word class before finding its stress pattern. With some word classes, for example Latinate words in the English language, the problem of parsing a word to determine if it belongs to the word class is not easy and the present invention seeks to find a solution to this problem.

Before describing an embodiment of this invention, some introductory comments will be made about the structure of words in the English language and this will be followed by some comments on two types of speech synthesis systems.

For the purpose of assigning stress patterns to words, the English language may be divided into two lexical classes, namely, "Latinate" and "Greco-Germanic". Words in the Latinate class are mostly of Latin origin, whereas words in the Greco-Germanic class are mostly Anglo-Saxon or Greek in origin. All Latinate words in English must be describable by the structure shown in FIG. 1. In this Figure, "level 1" means Latinate and "level 2" means Greco-Germanic. As shown in this Figure, Latinate or level 1 words can consist at most of a Latinate root with one or more Latinate prefixes and one or more Latinate suffixes. Latinate words can be wrapped by Greco-Germanic prefixes and suffixes, but level 2 affixes cannot come within a level 1 word.

Prefixes, roots and suffixes together with augments are known as morphemes.

The stress pattern of a word may be defined by the strength (strong or weak) and weight (heavy or light) of the individual syllables. The rules for assigning the stress patterns to Greco-Germanic words are well known to those skilled in the art. The main rule is that the first syllable of the root is strong. The rules for assigning the stress pattern to Latinate words will now be described.

A word may be divided into feet and each foot may be divided into syllables. As depicted in FIGS. 2 and 3, a Latinate word may comprise one, two or three feet, each foot may have up to three syllables, and the first syllable of each foot is strong and the remaining syllables are weak. In a single foot Latinate word, the stress fails on the first syllable. In a word having two or more feet, the primary stress falls on the first syllable of the last foot. In both Latinate and Greco-Germanic word classes, a heavy syllable has either a long vowel, for example, "beat" or two consonants at the end, for example, "bend". With some exceptions, heavy syllables in Latinate words are also strong. Heavy Latinate syllables which form suffixes are generally (irregularly) weak. Thus, after parsing a word into strong and weak syllables, the feet may be readily identified and stress may be assigned.

In one type of speech synthesis system, the input text is converted from graphemes into phonemes, the phonemes are converted into allophones, parameter values are found for the allophones and these parameter values are then used to drive a speech synthesizer which produces a speech waveform. The synthesis used in this type of system is known as segmental synthesis.

In another approach to a speech synthesis system known as YorkTalk, each syllable is parsed into its constituents, each constituent is interpreted to produce parameter values, the parameter values for the various constituents are overlaid on each other to produce a series of sets of parameter values, and this series is used to drive a speech synthesis. The type of speech synthesis used in YorkTalk is known as non-segmental synthesis. YorkTalk and a synthesizer which may be used with YorkTalk are described in the following references:

(i) J. K. Local: "Modelling Assimilation in Non-Segmental Rule-Synthesis"; in D. R. Ladd and G. Docherty (Editors): "Papers in Laboratory Phonology II", Cambridge University Press 1992.

(ii) J. Coleman: "Synthesis-by-Rule Without Segments or Rewrite-Rules"; G. Bailly, C. Beniot and T. R. Sawallis (Editors): "Talking Machines; Theories, Model and Designs", Elsevier Science Publishers, 1992, pages 43–60.

(iii) R. Ogden: "Temporal Interpretation of Polysyllabic Feet in the YorkTalk Speech Synthesis System", paper submitted to the European Chapter of the Association of Computational Linguistics 1992.

(iv) R. Ogden: "Parametric Interpretation in YorkTalk", York Papers in Linguistics 16 (1992), pages 81–99.

(v) D. H. Klatt: "Software for a Cascade/Parallel Format Synthesizer", Journal of the Acoustical Society of America 67(3), pages 971–995.

BRIEF SUMMARY OF THE INVENTION

According to one aspect of the present invention, there is provided a speech synthesis system for use in producing a speech waveform from an input text which includes words in a defined word class, said speech synthesis system including means for determining the phonological features of said input text, means for parsing each word of said input text to determine if the word belongs to said defined word class, said parsing means including a knowledge base containing (1) the individual morphemes utilized in said defined word class, each morpheme being an affix or a root, (2) the binding properties of each root and each affix, the binding properties for each affix also defining the binding properties of the combination of each affix and one or more other morphemes, and (3) a set of rules for defining the manner in which roots and affixes may be combined to form words, means responsive to the word parsing means for finding the stress pattern of each word of said input text, and means for interpreting said phonological features together with the output from said means for finding the stress pattern to produce a series of sets of parameters for use in driving a speech synthesizer to produce a speech waveform.

According to a second aspect of this invention, there is provided a method for use in producing a speech waveform from an input text which includes words in a defined word class, said method including the steps of determining the phonological features of said input text, parsing each word of said input text to determine if the word belongs to said defined word class, said parsing step including using a knowledge base containing (1) the individual morphemes utilized in said defined word class, each morpheme being an affix or a root, (2) the binding properties of each root and each affix, the binding properties for each affix also defining the binding properties of the combination of each affix and one or more other morphemes, and (3) a set of rules for defining the manner in which the roots and affixes may be combined to form words, finding the stress pattern of each word of said input text, said finding step using the results of said parsing step, and interpreting said phonological features together with the stress pattern found in said finding step to produce a series of sets of parameters for use in driving a speech synthesizer to produce a speech waveform.

BRIEF DESCRIPTION OF THE DRAWINGS

This invention will now be described in more detail, by way of example, with reference to the drawings in which.

DETAILED DESCRIPTION OF EXEMPLARY EMBODIMENTS

Figure 1:
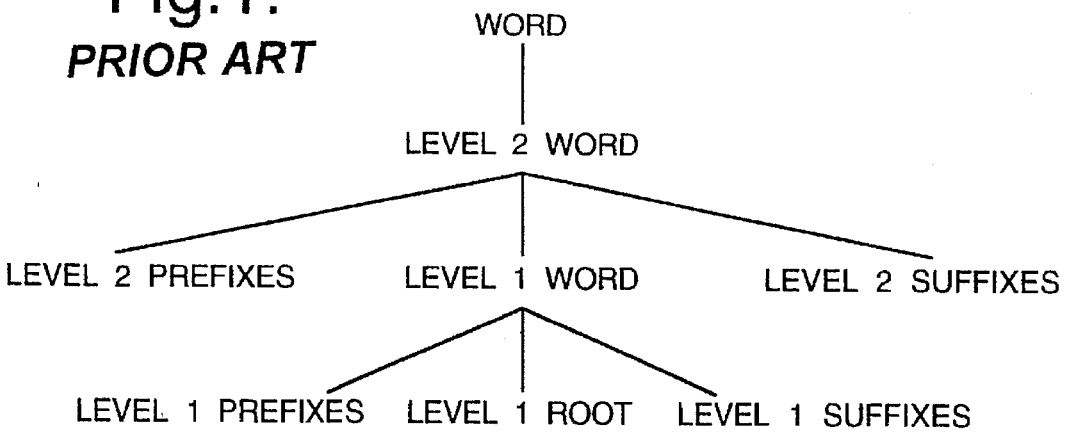
Fig.1. PRIOR ART
FIG. 1 shows the structure of Latinate words in the English language.
Figure 2:
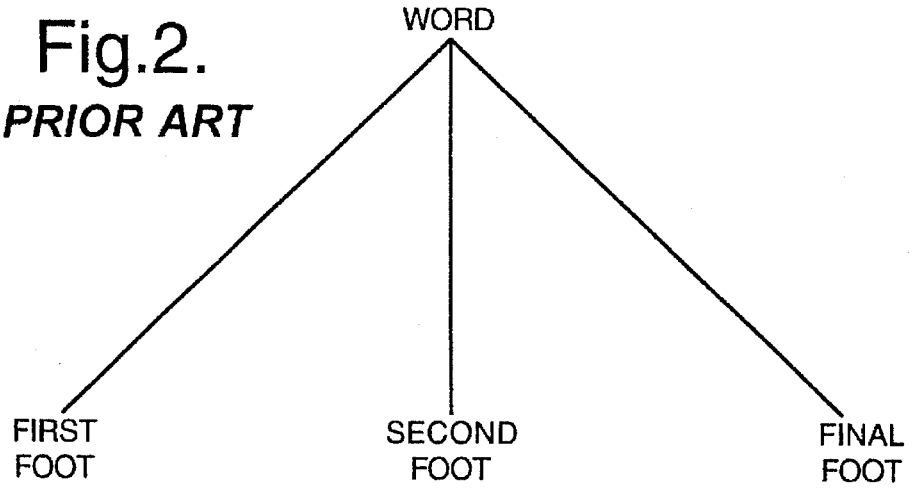
Fig.2. PRIOR ART
FIGS. 2 and 3 show how a Latinate word may be divided into Latinate feet and the feet into syllables.
Figure 3:
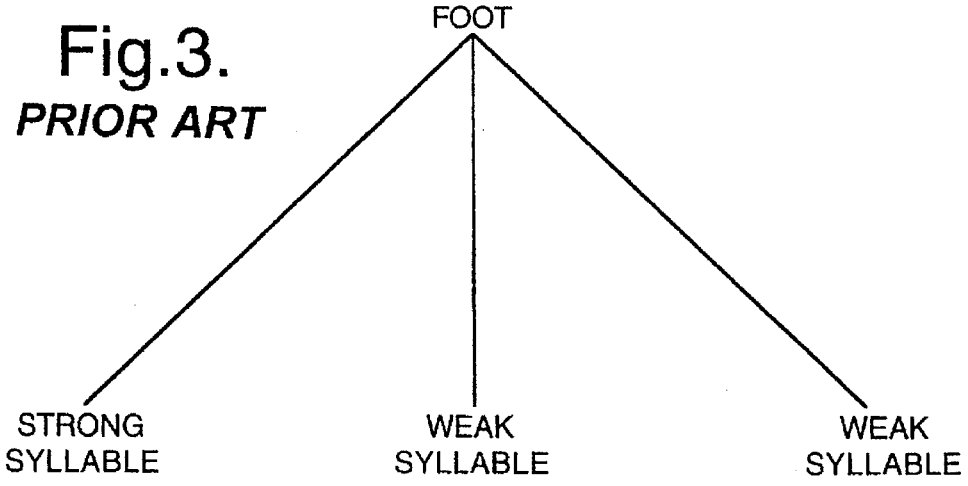
Fig.3. PRIOR ART
Figure 4:
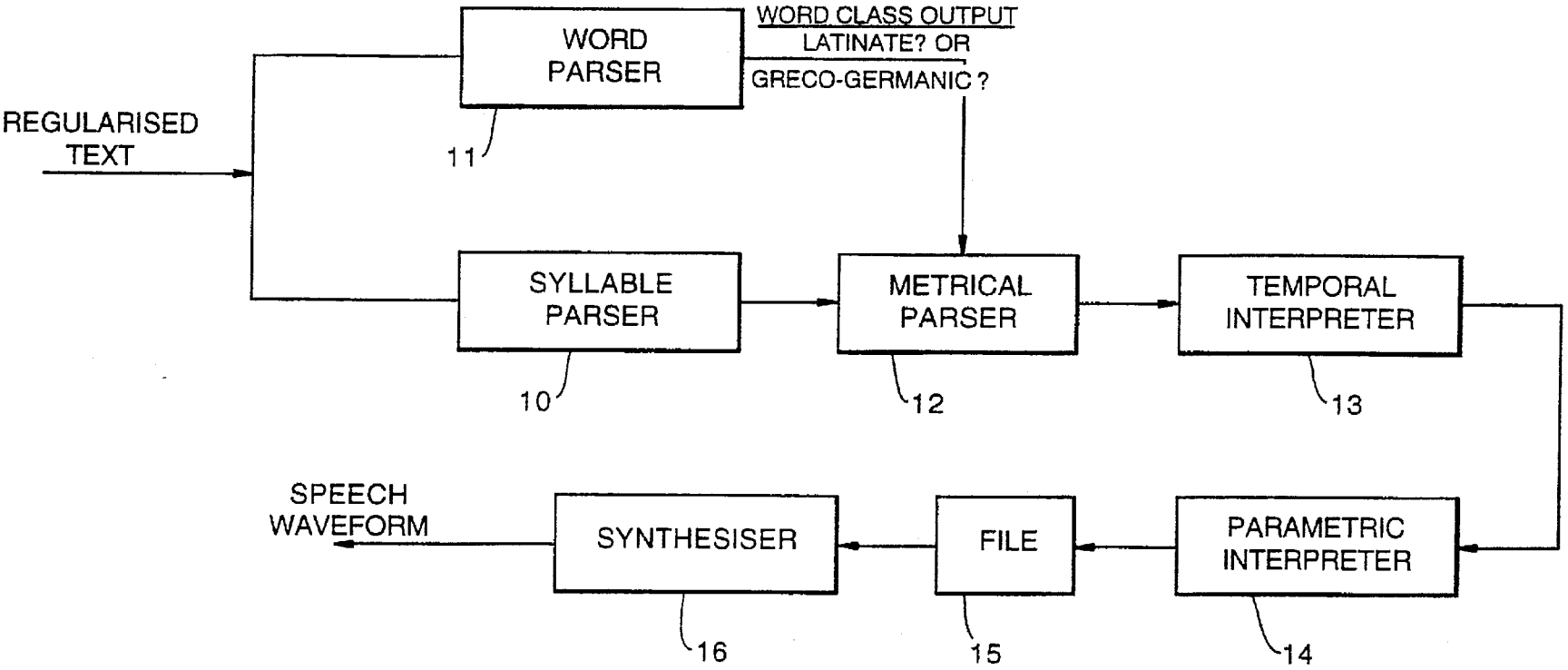
FIG. 4 is a block diagram of a speech synthesis system embodying this invention.

Referring now to FIG. 4, there is shown a modified YorkTalk speech synthesis system and this system will be described in relation to synthesizing speech from text derived from the Latinate class of English language words. The system of FIG. 4 includes a syllable parser 10, a word parser 11, a metrical parser 12, a temporal interpreter 13, a parametric interpreter 14, a storage file 15, and a synthesizer 16. The modules 10 to 16 are implemented as a computer and associated program.

The input to the syllable parser 10 and the word parser 11 is regularised text. This text takes the form of a string of characters which is generally similar to the letters of the normal text but with some of the letters and groups of letters replaced by other letters or phonological symbols which are more appropriate to the sounds in normal speech represented by the replaced letters. The procedure for editing normal text to produce regularised text is well known to those skilled in the art.

As will be described in more detail below, the word parser 11 determines whether each word belongs to the Latinate or Greco-Germanic word class and supplies the result to the metrical parser 12. It also supplies the metrical parser with the strength of irregular syllables.

Figure 5:
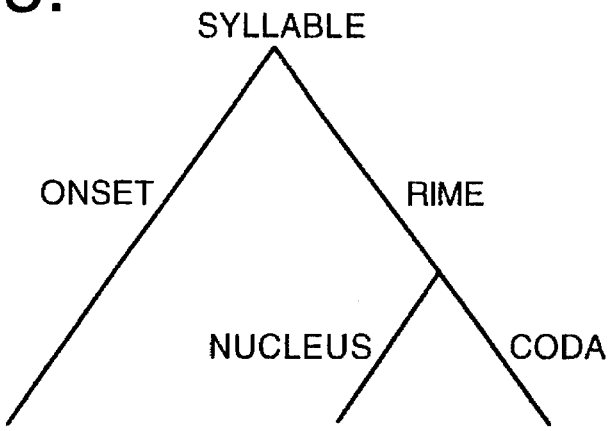
FIG. 5 illustrates the constituents of a syllable.

A syllable may be divided into an onset and a rime and the rime may be divided into a nucleus and a coda. One way of representing the constituents of a syllable is as a syllable tree, an example of which is shown in FIG. 5. An onset is formed from one or more consonants, a nucleus is formed from a long vowel or a short vowel and a coda is formed from one or more consonants. Thus, in the word "mat", "m" is the onset, "a" is the nucleus and "t" is the coda. All syllables must have a nucleus and hence a rime. Syllables can have an empty onset and/or an empty coda.

In the syllable parser 10, the string of characters of the regularised text for each word is converted into phonological features and the phonological features are then spread over the nodes of the syllable tree for that word. The procedure for doing this is well known to those skilled in the art. Each phonological feature is defined by a phonological category and the value of the feature for that category. For example, in the case of the head of the nucleus, one of the phonological categories is length and the possible values are long and short. The syllable parser also determines whether each syllable is heavy or light. The syllable parser supplies the results of parsing each syllable to the metrical parser 12.

The metrical parser 12 groups syllables into feet and then finds the strength of each syllable of each word. In doing this, it uses the information which it receives on the word class of each word from the word parser 11 and also the information which it receives from the syllable parser 10 on the weight of each syllable. The metrical parser 12 supplies the results of its parsing operation to the temporal interpreter 13.

Figure 6:
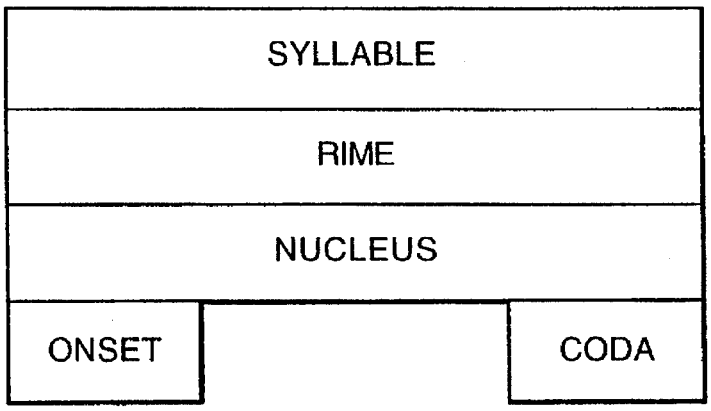
FIG. 6 shows the temporal relationship between the constituents of a syllable.

FIG. 6 illustrates the temporal relationship between the individual constituents of a syllable. As may be seen, the rime and the nucleus are coterminous with a syllable. The onset start is simultaneous with syllables start and coda ends at the end of the syllable. An onset or a coda may contain a cluster of elements.

The temporal interpreter 13 determines the durations of the individual constituents of each syllable from the phonological features of the characters which form that syllable. Temporal compression is a phonetic correlate of stress. The temporal interpreter 13 also temporally compresses syllables in accordance with their strength or weight.

The synthesizer 16 is a Klatt synthesizer as described in the paper by D H Klatt listed as reference (v) above. The Klatt synthesizer is a formant synthesizer which can run in parallel or cascade mode. The synthesizer 16 is driven by 21 parameters. The values for these parameters are supplied to the input of the synthesizer 16 at 5 ms intervals. Thus, the input to the synthesizer 16 is a series of sets of parameter values. The parameters comprise four noise making parameters, a parameter representing fundamental frequency, four parameters representing the frequency value of the first four formants, four parameters representing the bandwidths of the first four formants, six parameters representing amplitudes of the six formants, a parameter which relates to bilabials, and a parameter which controls nasality. The output of the synthesizer 16 is a speech waveform which may be either a digital or an analogue waveform. Where it is desired to produce an audible output without transmission, an analogue waveform is appropriate. However, if it is desired to transmit the waveform over a telephone system, it may be convenient to carry out the digital-to-analogue conversion after transmissions so that transmission takes place in digital form.

The parametric interpreter 14 produces at its output the series of sets of parameter values which are required at the input of the synthesizer 16. In order to produce this series of sets of parameters, it interprets the phonological features of the constituents of each syllable. For each syllable the rime and the nucleus and then the coda and onset are interpreted. The parameter values for the coda are overlaid on the parameter values for the nucleus and the parameter values for the onset are overlaid on those for the rime. When parameter values of one constituent are overlaid on those of another constituent, the parameter values of the one constituent dominate. Where a value is given for a particular parameter in one constituent but not in the other constituent, this is a straightforward matter as the value for the one constituent is used. Sometimes, the value for a parameter in one constituent is calculated from values in another constituent. Where two syllables overlap, the parameter values for the second syllable are overlaid on those for the first syllable. Temporal and parametric interpretation are described in references (i), (iii) and (iv) cited above. Temporal and parametric interpretation together provide phonetic interpretation which is a process generally well known to those skilled in the art.

It was mentioned above that temporal compression is a phonetic correlate of stress. Amplitude and pitch may also be regarded as phonetic correlates of stress and the parametric interpreter 14 may take account of the strength and weight of the syllables when setting the parameter values.

The sets of values produced by the interpreter 14 are stored in a file 15 and then supplied by the file 15 to the speech synthesizer 16 when the speech waveform is required. By way of an alternative, the speech synthesis system shown in FIG. 4 may be used to prepare sets of parameters for use in other speech synthesis systems. In this case, the other systems need comprise only a synthesizer corresponding to the synthesizer 16 and a file corresponding to the file 15. The sets of parameters are then read into the files of these other systems from the file 15. In this way, the system of FIG. 4 may be used to form a dictionary or part of a dictionary for use in other systems.

The word parser 11 will now be described in more detail.

The word parser 11 has a knowledge base containing a dictionary of roots and affixes of Latinate words and a set of rules defining how the roots and affixes may be combined to form words. As mentioned above, roots and affixes are collectively known as morphemes. For each root or affix, the information in the dictionary includes the class of the item, its binding features and certain other features. For affixes the binding features define both how the affix may be combined with other affixes or roots and also the binding properties of the combination of the affix and one or more other morphemes. The word parser 11 uses this knowledge base to parse the individual words of the regularised text which it receives as its input. The dictionary items, the rules for combining the roots and affixes and the nature of the information on each root or affix which is stored in the dictionary will now be described.

As mentioned above, the dictionary items comprise roots and affixes. The affixes are further divided into prefixes, suffixes and augments. Each of these will now be described. Any Latinate word must consists of at least a root. A root may be verbal, adjectival or nominal. There are a few adverbial roots in English but, for simplicity, these are treated as adjectives.

Latinate verbal roots are based either on the present stem or the past stem of the Latin verb. Verbal roots can thus be divided into those which come from the present tense and those which come from the past tense. Nominal roots when not suffixed form nouns. Nominal roots cannot be broken down into any further subdivisions. Adjectival roots form adjectives when not suffixed but they combine with a large number of suffixes to produce nouns, adjectives and verbs. Adjectival roots cannot be broken down into any further subdivisions.

Prefixes are defined by the fact that they come before a root. A prefix must have another prefix or a root on its right and thus prefixes must be bound on their right.

A suffix must always follow a root and it must be bound on its left. A suffix usually changes the category of the root to which it is attached. For example, the addition of the suffix "-al" to the word "deny" changes it into "denial" and thus changes its category from a verb to a noun. It is possible to have many suffixes after each other as is illustrated in the word "fundamental". There are a number of constraints on multiple suffixes and these may be defined in the binding properties. Some suffixes, for example the suffix "-ac-", must be bound on both their left and their right.

Augments are similar to suffixes but have no semantic content. Augments generally combine with roots of all kinds to produce augmented roots. There are three augments which are spelled respectively with: "i", "a" and "u". In addition there are roots which do not require an augment. Examples of roots which contain an augment are: "fund-a-mental", "imped-i-ment" and "mon-u-ment". An example of a word which does not require an augment is "seg-ment". Sometimes an augment must include the letter "t" after the "i", "a" or "u". Examples of such words are: "definition", "revolution" and "preparation". In the following description, augments which include a "t" will be described as being "consonantal" Augments which do not require the consonant "t" will be referred to as "vocalic". Generally, "t" marks the past tense.

There is a further small class of augments which consist of a vowel and a consonant and appear with nominal roots only. The two main ones are "-in-" and "-ic-", as in "crim-in-al" and "ded-ic-ate". In the dictionary, the suffix "id-" as in "rapid" and "rigid" is treated as an augment.

The rules which define how words may be parsed into roots and affixes are as follows:

1. word(cat A)→prefix(cat A/A)word(cat A)
2. word(cat A)→root(cat B)suffix1(cat B\A)
3. word(cat A)→root(cat A)
4. suffix1(cat A)→suffix(cat A)
5. suffix1(cat A)→augment(cat A)
6. suffix1(cat A\B)→augment(cat A\C)suffix(cat C\B)
7. suffix1(cat A\B)→suffix(cat A\C)suffix(cat C\B)

Rule 1 means that a word may be parsed into a prefix and a further word. The term "word" on the right hand side of rule 1 covers both a word in the sense of a full word and also the combination of a root and one or more affixes regardless of whether the combination appears in the English language as a word in its own right. Rule 2 states that a word can be parsed into a root and an item which is called "suffix1" This item will be discussed in relation to rules 4 to 7. Rule 3 states that a word can be parsed simply as a root. Rules 4 to 7 show how the item "suffix1" may be parsed. Rule 4 states it may be parsed as a suffix, rule 5 states that is may be parsed as an augment, rule 6 states that i t may be pars ed into an augment and a further "suffix1", and rule 7 states that it may be parsed into a suffix and a further "suffix1" Thus, in the parsing, the "prefix", "root", "suffix" and "augment" are terminal nodes. For the complete parsing of a word, it may be necessary to use several of the rules.

Figure 7:
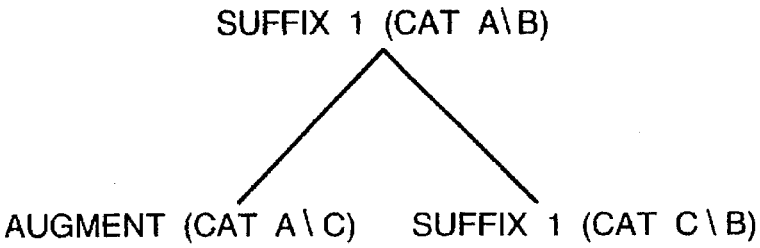
FIG. 7 is a graph for illustrating one of rule rules defining the formation of words in the Latinate class of words in the English language.

These rules also state the constraints which must be satisfied in order for the successful combination of roots and affixes to form words. This is done by means of matching the features of the roots. "cat A" means simply a thing having features of category A. The slash notation is interpreted as follows: "Cat A/C" means it combines with a thing having features of category C on the right to produce a thing of category A. "Cat A\C" means it combines with a thing having features of category A on the left to produce a thing having features of category C. Rule 7 is illustrated graphically in FIG. 7.

As mentioned above, for each root or affix, the dictionary defines certain features of the item and these features include both its lexical class and binding properties. In fact, for each item the dictionary defines five features. These are lexical class, binding properties, verbal tense, a feature that will be referred to as "palatality" and the augment feature. For each item, each feature is defined by one or more values. In the rules above, reference to an item having features in category A means an item for which the values of the five features together are in category A. These individual features will now be described.

There are three lexical classes, namely, nominal, verbal and adjectival and in the following description these are denoted by "n", "v" and "a". These classes are subdivided into root, suffix, prefix and augment. In the following description, these will be denoted by "root", "suff", "prefix" and "aug". Thus, "n(root)" means a nominal which is a root, "v(aug)" means a verbal which is augmented, and "a(suff)" means an adjectival which is suffixed.

There are two slots to define the binding properties. The left hand slot refers to the binding properties of the item on its left side and the right slot to the binding properties on the right side. Each slot may have one of three values, namely, "f", "b", or "u". "f" stands for must be free, "b" stands for must be bound, while "u" stands for may be bound or free. By definition prefixes must be bound on the right and suffixes must be bound on the left. Thus, the value for a prefix is (_,b). The "underscore" stands for either not yet decided or irrelevant.

The verbal tense may have two values, namely, "pres" or "past", referring to present or past tense of the verbal root as described above.

The palatality feature indicates whether or not an item ends in a palatal consonant. If it does end in a palatal consonant, it is marked "pal". If it does not have palatal consonant at the end, it is marked by "-pal". For example, in "con-junct-ive", the root "junct" does not end in a palatal consonant. On the other hand, in the word "con-junct-ion", the root "junct" does end in a palatal consonant. The suffix "-ion" requires a root which ends in a palatal consonant.

In the examples which follow, the augment feature is marked by "aug" and two slots are used to define the values of this feature. The first slot normally contains one of the three letters "i", or "a", or "u" or the numeral "0". The three letters simply refer to the augments "-i-", "-a-" and "-u-". The numeral "0" is used for roots which do not require an augment. The second slot normally contains one of the two letters "c" or "v", and this defines whether the augment is consonantal or vocalic. In the case of the augments "-in-", "-ic-" and "-id-", only the first slot is used and this is marked with the relevant augment. For example, the augment "-in-", is marked as "aug(in,_)".

There will now be given some examples of the dictionary items for roots, prefixes, suffixes and augments. In these examples, regularised spelling is used and the individual letters or phonological symbols are separated by commas for clarity.

A. Roots

| A. Roots | |
|---|---|
| 1. ([l,a,y,s], | (v(root), (f,b),pres,-pal,aug(0,_))). |
| 2. ([p,l,i,k], | (v(root), (b,b,),pres,-pal,aug(a,c))). |
| 3. ([s,a,n,k,sh], | (v(root), (f,b),past,pal,aug(0,_))). |
| 4. ([s,i,m,p,l,], | (a(root), (f,b),_,-pal, aug(0,_))). |
| 5. ([n,a,v], | (n(root), (f,b,),-pal, aug(ig,_))). |

(1) is a verbal root which may not be prefixed but must be suffixed ("(f,b)"). The root is present tense and not palatal, and it does not require an augment. The root appears in the word 'licence'. (2) is a present tense verbal root which is the root in the word 'complicate'. It must be suffixed and prefixed and the augment must be both a-augment and the consonantal version, ie -at. (3) is past tense and palatal and requires no augment; it may not be prefixed but must be suffixed. It appears in the word 'sanction'. (4) is adjectival and so the tense feature is irrelevant, hence the underscore. It may not be prefixed but must be suffixed if for no other reason than that it is not a well formed syllable. It requires no augment. It appears in the word 'simplify'. (5) is a nominal root, it may not be prefixed, but it must have some suffix. It is not palatal, and it is augmented with the augment -ig-. This root appears in the word 'navigate'.

B. Prefixes

Only one example is required here, because all prefixes have the same feature structure.

| | |
|---|---|
| ([a,d], | (Category,(u,A),B,C,D)/(Category,(_,A),B,C,D)). |

This says that the prefix 'ad' requires something with a feature specification "(Category,(_,A),B,C,D)". The capital letters stand for values of features which are inherited and passed on. The prefix will produce something with the features "(Category,(u,A),B,C,D)", ie the prefixed word will have exactly the same category as the unprefixed one except that it may be bound or free on the left side. In other words there may or may not be another prefix. Thus, the data in the dictionary includes the binding properties of the prefixed word. The prefixed word is the combination of the prefix and one or more other syllables.

C Suffixes

| | |
|---|---|
| 1. ([m,@,n,t], | (v(root), (A,_),pres,aug(O,_))\ (n(suff), (A,u),_,_aug(a,c))). |
| 2. ([i,v], | (v(aug), (A,_),past,-pal,aug(_,c))\ (a(suff), (A,u),_,-pal,aug(a,c))). |
| 3. ([@,l], | (n(root), (A,_),_,_,_)\ (a(suff), (A,f),_,_,_)). |
| 4. ([i,t,i], | (a(root), (A,_),_,-pal,aug(_,c))\ (n(suff), (A,f),_,_,_)). |
| 5. ([b,@,l], | (v(aug), (A,b),_,_,aug(_,v))\ (a(suff), (A,f),_,_,_)). |

(1) needs a verbal root on its left which is present tense and which requires no augment. It produces a noun which has been suffixed and which can be free or bound on the right side, and which uses -at- as its augment. It binding properties to the left are the same as those of the verbal root to which it attaches. This suffix appears in the word 'segment', or 'segmentation'. (2) needs a verb which has been augmented with a consonantal augment and which is past tense and not palatal. It produces an adjective which has been suffixed, which may or may not be bound on the right (ie there may be another suffix, but equally it can be free). It is not palatal, and the augment it requires, if any, is the a-augment in its consonantal form. This suffix appears in the word 'preparative'. (3) binds with any noun root to produce a suffixed adjective which cannot be suffixed. This suffix appears in the words 'crucial', 'digital', 'oval'. (4) combines with an adjectival root which is not palatal and which can have a consonantal augment. It produces a noun which may not be suffixed. It is found in the word 'serenity'. (5) attaches to an augmented verb. The verb can be either tense, but the augment must be the vocalic one. It produces an adjective which cannot be suffixed. It appears in the words 'visible', 'soluble' and 'legible'.

D Augments

| | |
|---|---|
| 1. ([u,w,sh], | (v(root), (A,B),pres,-pal,aug(u,c))\ v(aug), (A,b),past,pal,aug(u,c))). |
| 2. ([i], | (v(root), (A,B),C,D,aug(i,v))\ (v(aug), (A,b),C,D,aug(i,v))). |
| 3. ([@], | (n(root), (A,B),C,D,aug(a,v))\ (v(aucr), (A,b),C,D,aug(a,v))). |

(1) requires a verbal root which is present tense, not palatal and which can have the u-augment in its consonantal form. The result of attaching the augment to the root is an augmented verb which must be bound on its right (ie it demands a suffix), which is past tense, palatal, and has been augmented with the consonantal u-augment. This augment appears in the word 'revolution'. (2) requires a verbal root which can accept the vocalic i-augment. It produces an augmented verb with the same features as the unaugmented verbal root, except that it must be bound on the right. This augment appears in the word 'legible'. (3) needs a nominal root which can accept the vocalic a-augment. It produces an augmented verb which must be bound on the right. This is one of the augments that serves to change the category of a root. The a-augment is regularly used in Latin to change a nominal into a verbal. It appears in the word 'amicable'.

Figure 8:
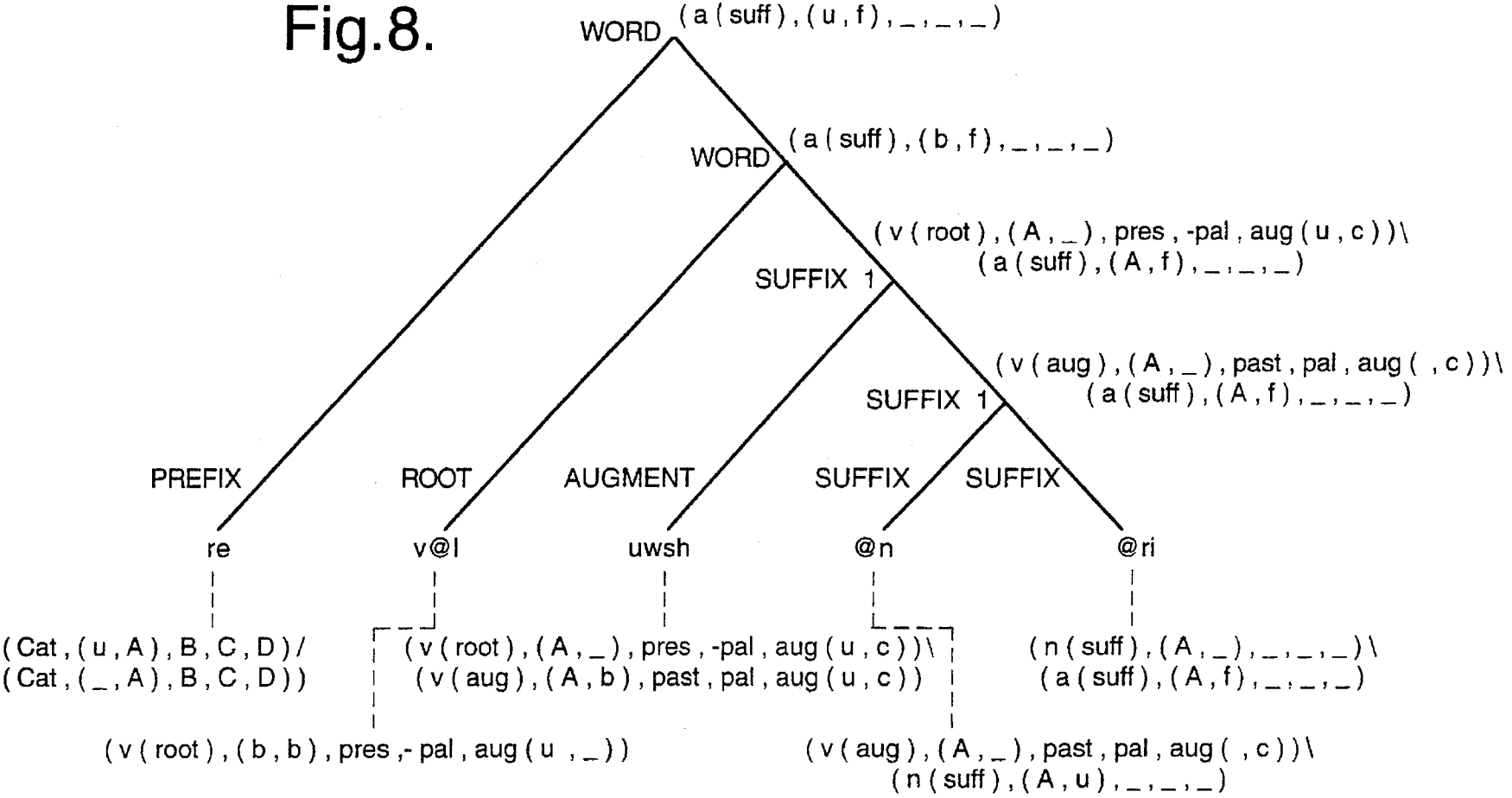
FIG. 8 illustrates the parse of a complete word.

FIG. 8 shows how the word "revolutionary" may be parsed using the dictionary and rules described above. The dictionary entries are shown for each node. In the case of the prefix "re-", the abbreviation "Cat" stands for category. The top-node category is "a(suff), (u. f),- ,- , -)" These means an adjective which has been suffixed which can be prefixed but not suffixed.

If the parser 11 is able to parse a word as a Latinate word, it determines the word as being a Latinate word. If it is unable to parse a word as a Latinate word, it determines that the word is a Greco-Germanic word. The knowledge base containing the dictionary of morphemes together with the rules which define how the morphemes may be combined to form words ensure that each word may be parsed accurately as belonging to, or not belonging to, as the case may be, the Latinate word class.

Although the present invention has been described with reference to the Latinate class of English words, the general principles of this invention may be applied to other lexical classes. For example, the invention might be applied to parsing English language place names or a class of words in another language. In order to achieve this, it will be necessary to construct a knowledge base containing a dictionary of morphemes used in the word class together with their various features including their binding properties and also a set of rules which define how the morphemes may be combined to form words. The knowledge base could then be used to parse each word to determine if it belongs to the class of words in question. The result of parsing each word could then be used in determining the stress pattern of the word.

The present invention has been described with reference to a non-segmental speech synthesis system. However, it may also be used with the type of speech synthesis system, described above in which syllables are divided into phonemes in preparation for interpretation.

Although the present invention has been described with reference to a speech synthesis system which receives its input in the form of a string of characters, the invention is not limited to a speech synthesis system which receives its input in this form. The present invention may be used with a synthesis system which receives its input text in any linguistically structured form.

I claim:

1. A speech synthesis system for use in producing a speech waveform from an input text which includes words in a defined word class, said speech synthesis system including:

means for determining the phonological features of said input text;

means for parsing each word of said input text to determine if the word belongs to said defined word class, said parsing means including a knowledge base containing (1) the individual morphemes utilized in said defined word class, each morpheme being an affix or a root, (2) the binding properties of each root and each affix, the binding properties for each affix also defining the binding properties of the combination of each affix and one or more other morphemes, and (3) a set of rules for defining the manner in which roots and affixes may be combined to form words;

said means for parsing each word including means to determine whether a word being parsed consists of morphemes present in the knowledge base combined in accordance with said binding properties and said set of rules;

means responsive to the word parsing means for finding the stress pattern of each word of said input text; and means for interpreting said phonological features together with the output from said means for finding the stress pattern to produce a series of sets of parameters for use in driving a speech synthesizer to produce a speech waveform.

2. A speech synthesis system as in claim 1, in which said means for determining the phonological features includes means to spread the phonological features for each syllable over a syllable tree for that syllable, the syllable tree dividing the syllable into an onset and a rime, and the rime into a nucleus and a coda.

3. A speech synthesis system as in claim 1, in which said input text is in the form of a string of input characters.

4. A speech synthesis system as in claim 1, including a memory for storing said series of sets of parameter values produced by the means for interpreting.

5. A speech synthesis system as in claim 1 including a speech synthesizer for converting said series of sets of parameter values into a speech waveform.

6. A speech synthesis system as in claim 5, in which said speech waveform is a digital waveform.

7. A speech synthesis system as in claim 5, in which said speech waveform is an analogue waveform.

8. A speech synthesis system as in claim 1 wherein:

said parsing means includes means for determining whether a word being parsed meets a predetermined criterion and, according to whether the word does or does not meet the said criterion, outputting information indicating respectively that the word does or does not belong to said defined class, said criterion being met by a word consisting of a root wherein the root is present in the knowledge base and has binding properties requiring no binding and said criterion being met by a word consisting of a root and at least one affix wherein said root and said affix are all present in the knowledge base and are combined in accordance with said binding properties and rules.

9. A method for use in producing a speech waveform from an input text which includes words in a defined word class, said method comprising the steps of:

determining the phonological features of said input text;

parsing each word of said input text to determine if the word belongs to said defined word class, said parsing step including using a knowledge base containing (1) the individual morphemes utilized in said defined word class, each morphemes being an affix or a root, (2) the binding properties of each root and each affix, the binding properties for each affix also defining the binding properties of the combination of each affix and one or more other morphemes, and (3) a set of rules for defining the manner in which roots and affixes may be combined to form words;

said parsing step including determining whether a word being parsed consists of morphemes present in the knowledge base combined in accordance with said binding properties and set of rules;

finding the stress pattern of each word of said input text, said finding step using the result of said parsing step; and interpreting said phonological features together with the stress pattern found in said finding step to produce a series of sets of parameters for use in driving a speech synthesizer to produce a speech waveform.

10. A method as in claim 9, in which said step of determining the phonological features spreads the phonological features for each syllable over the syllable tree for that feature, the syllable tree dividing the syllable into an onset and as rime and the rime into a nucleus and a coda.

11. A method as in claim 9, in which said input text is in the form of a string of input characters.

12. A method as in claim 9, farther including the step of storing said series of sets of parameter values.

13. A method as in claim 9, further including the step of converting said series of sets of parameter values into a speech waveform.

14. A speech synthesis method as in claim 9 wherein:

said parsing step includes determining whether a word being parsed meets a predetermined criterion and, according to whether the word does or does not meet the said criterion, outputting information indicating respectively that the word does or does not belong to said defined class, said criterion being met by a word consisting of a root wherein the root is present in the knowledge base and has binding properties requiring no binding and said criterion being met by a word consisting of a root and at least one affix wherein said root and said affix are all present in the knowledge base and are combined in accordance with said binding properties and rules.

* * * * *